US008449342B2

(12) United States Patent
Goode

(10) Patent No.: US 8,449,342 B2
(45) Date of Patent: May 28, 2013

(54) SAFETY FLOTATION BUOY SYSTEM

(75) Inventor: David Paul Goode, Huntsville, UT (US)

(73) Assignee: D2 Investments, LLC, Ogden, UT (US)

( * ) Notice: Subject to any disclaimer, the term of this patent is extended or adjusted under 35 U.S.C. 154(b) by 101 days.

(21) Appl. No.: 12/877,292

(22) Filed: Sep. 8, 2010

(65) Prior Publication Data

US 2012/0058695 A1 Mar. 8, 2012

(51) Int. Cl.
*B63B 22/16* (2006.01)

(52) U.S. Cl.
USPC ..... 441/6

(58) Field of Classification Search
USPC ..... 441/1–3, 6, 21, 22, 28, 32
See application file for complete search history.

(56) References Cited

U.S. PATENT DOCUMENTS 3,121,889 A * 2/1964 Gentile ..... 441/6
3,568,228 A * 3/1971 Rudelick ..... 441/3
4,731,036 A * 3/1988 Ulf ..... 441/2
5,066,256 A * 11/1991 Ward, Sr. ..... 441/7

* cited by examiner

*Primary Examiner* — Daniel Venne
(74) *Attorney, Agent, or Firm* — Trent H. Baker; Baker & Associates PLLC

(57) ABSTRACT

The invention generally relates to a safety flotation buoy system. One embodiment of the present invention relates to a buoy system comprising a designation member and a buoyancy structure coupled to the designation member. The designation member may include a cylindrically shaped flexible rubber region and a lengthwise opening. The opening may be oriented substantially normal to the water surface. The lengthwise orientation of the buoyancy structure may be aligned with the opening of the designation member. The buoyancy structure may be configured to be submerged below the designation member and the water surface so as to enable the formation of an air bubble within an internal region of the designation member.

8 Claims, 4 Drawing Sheets

SAFETY FLOTATION BUOY SYSTEM

FIELD OF THE INVENTION

The invention generally relates to a safety flotation buoy system. In particular, the present invention relates to an improved buoy system that automatically deforms upon impact.

BACKGROUND OF THE INVENTION

Buoys are flotation members configured to designate a particular location in a body of water or on a water surface. Buoys are used in both oceans and lakes for a variety of designation purposes. One particular type of a buoy is used on lakes to designate various hazards and/or water ski courses. Conventional lake or fresh water buoys are inflated members filled with compressed air so as to create sufficient buoyancy. The weight of the buoy causes a gravitational sinking force which is balanced by the inherent buoyancy properties of the compressed air contained within the buoy shell. The balance between buoyancy and weight causes the buoy to partially float above the water, thereby allowing for visual designation of a particular location on a water surface.

One of the problems with traditional buoys is the danger posed to water skiers upon impact. Certain water skiing competitions require participants to encircle a course designated with a series of buoys. In order to optimize performance, participants generally steer their water skis within close proximity of the buoys at high speeds. Therefore, it is common for water skiers to impact a buoy with their ski during competition. Upon impact, conventional inflated buoys affect the water skier by either deflecting and/or elevating the trajectory of the water ski. At high speeds, the inflated buoy is submerged but the buoyancy forces are transferred to the water ski, thereby causing the trajectory affects. Unfortunately, at high speeds, this may include elevating the water skier above the water surface and subsequently causing a high force impact when the water skier descends back to the water surface. The subsequent high force impact may result in damage to one or both of the water skier's ankles or feet in the form of sprains or breaks.

Therefore, there is a need in the industry for a buoy that is capable of designating visual surface positions on a body of water without causing injury to a water skier as a result of high speed impact.

SUMMARY OF THE INVENTION

The invention generally relates to a safety flotation buoy system. One embodiment of the present invention relates to a buoy system comprising a designation member and a buoyancy structure intercoupled with one another in a lengthwise orientation. The designation member may include a cylindrically shaped flexible rubber region and a lengthwise opening. The opening may be oriented substantially normal to the water surface. The lengthwise orientation of the buoyancy structure may be aligned with the opening of the designation member. The buoyancy structure may be configured to be submerged below the designation member and the water surface so as to enable the formation of an air bubble within an internal region of the designation member. A second embodiment of the present invention relates to a method for supporting a buoy on a water surface without the use of compressed air. The method may include coupling the buoyancy structure to the designation member, submerging the buoyancy structure and part of the designation member below the water surface, and forming an internal air bubble within the flexible rubber region of the designation member.

Embodiments of the present invention represent a significant advance in the field of buoy systems. Conventional buoys utilize a compressed air region to both serve as a visual designator and provide sufficient flotation/buoyancy of the visual designation region. In contrast, embodiments of the present invention combine an internal non-pressurized air bubble to provide the elevated visual designation and a separate submerged buoyancy structure to provide the necessary flotation/buoyancy of the visual designation with respect to the water surface. This novel separation of the buoyancy and visual designation functions of the buoy enables improved safety of use while maintaining the functionality of a convention buoy. Embodiments of the present invention include a partially enclosed flexible designation member with an opening configured to be oriented toward the water surface. A corresponding buoyancy structure is coupled below the designation member and below the opening such that the buoyancy structure and part of the designation member may be submerged within the water surface. The partial submersion of the designation member and orientation of the buoyancy structure creates an enclosed region within the designation member and the water surface. The natural effect of this enclosed region is to create a non-pressurized air bubble within the enclosed internal region. The non-pressurized air bubble causes the designation member to remain elevated above the water surface. The low internal air pressure of the non-pressurized air bubble enables the air bubble to easily transfer through the opening, thereby deflating the designation member. Therefore, if the designation member is impacted by a water ski or other device, the designation member may easily be deflated without significantly affecting the trajectory of the impacting device.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The following description of the invention can be understood in light of the Figures, which illustrate specific aspects of the invention and are a part of the specification. Together with the following description, the Figures demonstrate and explain the principles of the invention. In the Figures, the physical dimensions may be exaggerated for clarity. The same reference numerals in different drawings represent the same element, and thus their descriptions will be omitted.

DETAILED DESCRIPTION OF THE INVENTION

Figure 1:
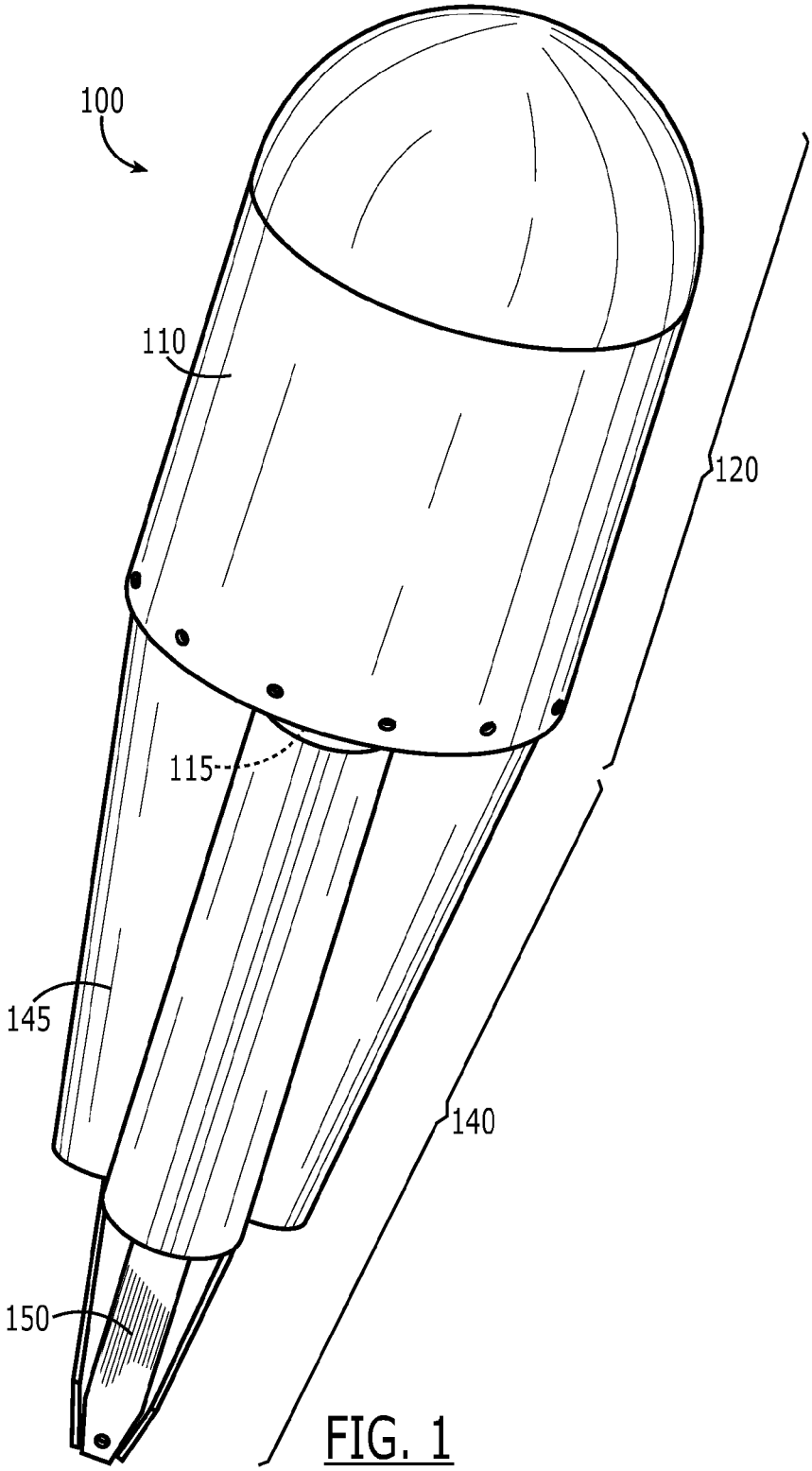
FIG. 1 illustrates a perspective view of an assembled buoy system in accordance with embodiments of the present invention.
Figure 2:
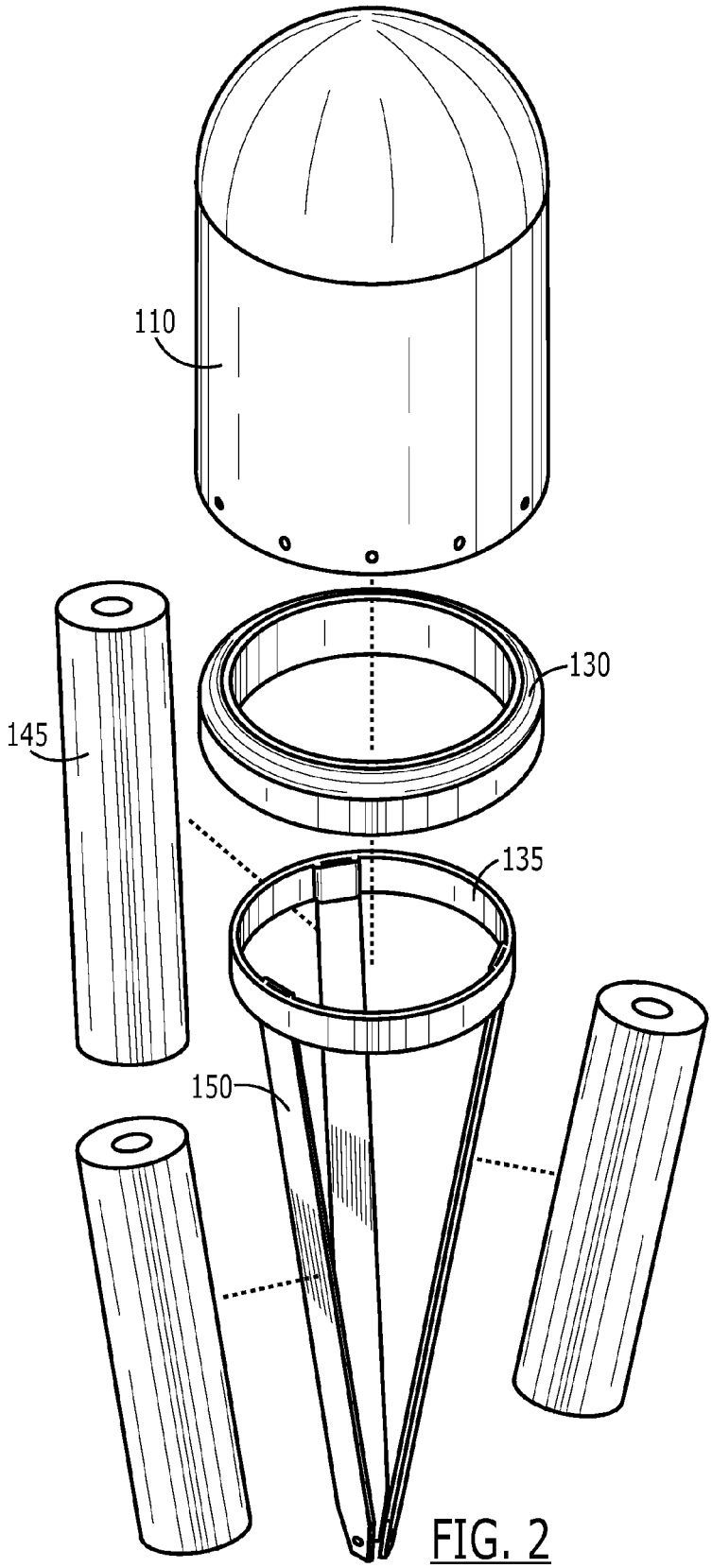
FIG. 2 illustrates an exploded view of the buoy system illustrated in FIG. 1.

The invention generally relates to a safety flotation buoy system. One embodiment of the present invention relates to a buoy system comprising a designation member and a buoyancy structure coupled to the designation member. The designation member may include a cylindrically shaped flexible rubber region and a lengthwise opening. The opening may be oriented substantially normal to the water surface. The lengthwise orientation of the buoyancy structure may be aligned with the opening of the designation member. The buoyancy structure may be configured to be submerged below the designation member and the water surface so as to enable the formation of an air bubble within an internal region of the designation member. A second embodiment of the present invention relates to a method for supporting a buoy on a water surface without the use of compressed air. The method may include coupling the buoyancy structure to the designation member, submerging the buoyancy structure and part of the designation member below the water surface, and forming an internal air bubble within the flexible rubber region of the designation member. Also, while embodiments are described in reference to a water ski lake buoy, it will be appreciated that the teachings of the present invention are applicable to other areas, including but not limited to other types of buoys.

Reference is initially made to FIGS. 1-4, which illustrate various views of a buoy system, designated generally at 100. The system 100 includes a designation member 120 and a buoyancy structure 140 intercoupled with one another in a particular lengthwise configuration. The designation member 120 includes a flexible rubber member 110 and an opening 115. The flexible rubber member 110 defines a partially enclosed internal region externally exposed via the opening 115. The flexible rubber member 110 may be composed of a plastic rubber material having a durometer of approximately 55. The composition of the flexible rubber member 110 may also include a high-visibility external color such as red or green. The external color of the flexible rubber member 110 may be selected to optimize contrast on a particular body of water and/or to designate a particular type of region or obstacle. The flexible rubber member 110 is substantially cylindrically shaped. The opening 115 is disposed on one of the lengthwise ends of the flexible rubber member 110. A convex region is disposed on the opposite lengthwise end of the flexible rubber member 110. The convex region includes a particular curvature to further bias towards being deflected rather than punctured by impacting objects. Alternative embodiments of the present invention may include some form of illumination system within the internal region of the flexible rubber member 110, for example a LED system housed within the internal region. The illumination system may be configured to perform various illumination operations including but not limited to flashing, remote operation, proximity sensing, etc.

The buoyancy structure 140 further includes a frame 135, a plurality of conically oriented members 150, and a plurality of buoyancy members 145. The frame 135 is shaped to correspond to the opening 115 of the designation member 120. In particular, the frame is shaped to both fit within and correspond to the shape of the opening 115. The frame 135 may be composed of a substantially rigid and non-corrosive material such as plastic. The plurality of conically oriented members 150 are coupled to the frame 135. Each of the conically oriented members 150 are lengthwise-shaped members that are coupled to the frame in an orthogonal orientation. In addition, one of the lengthwise ends of each conically oriented member 150 is coupled to the frame at a particular equidistant location from the other conically oriented members 150. The lengthwise coupling configuration of the conically oriented members 150 causes the opposite or distal ends of the conically oriented members 150 to be disposed in substantial proximity to one another. Therefore, the resulting combined shape of the plurality of conically oriented members 150 is conical, wherein the tip of the resulting conical shape is oriented away or distal from the frame 135. The length of the conically oriented members 150 is longer than the lengthwise or longest dimension of the flexible rubber member 110 of the designation member 120. The plurality of buoyancy members 145 are cylindrically shaped members configured to slidably engage with the plurality of the conically shaped members 150. As illustrated in the cross sectional view of FIG. 3, the buoyancy members 145 each include an internal channel through which a corresponding conically shaped member 150 may be routed so as to slidably engage. The buoyancy members 145 are composed of a buoyant material such as foam. The thickness or diameter of each buoyancy member 145 is configured to provide sufficient buoyancy properties to the system. In addition, the length of the buoyancy members 145 is selected to correspond to the length of the conically oriented members 150. As illustrated in the exploded view of FIG. 2, the buoyancy members 150 are releasably engaged with the conically oriented members 150 to facilitate replacement.

Figure 3:
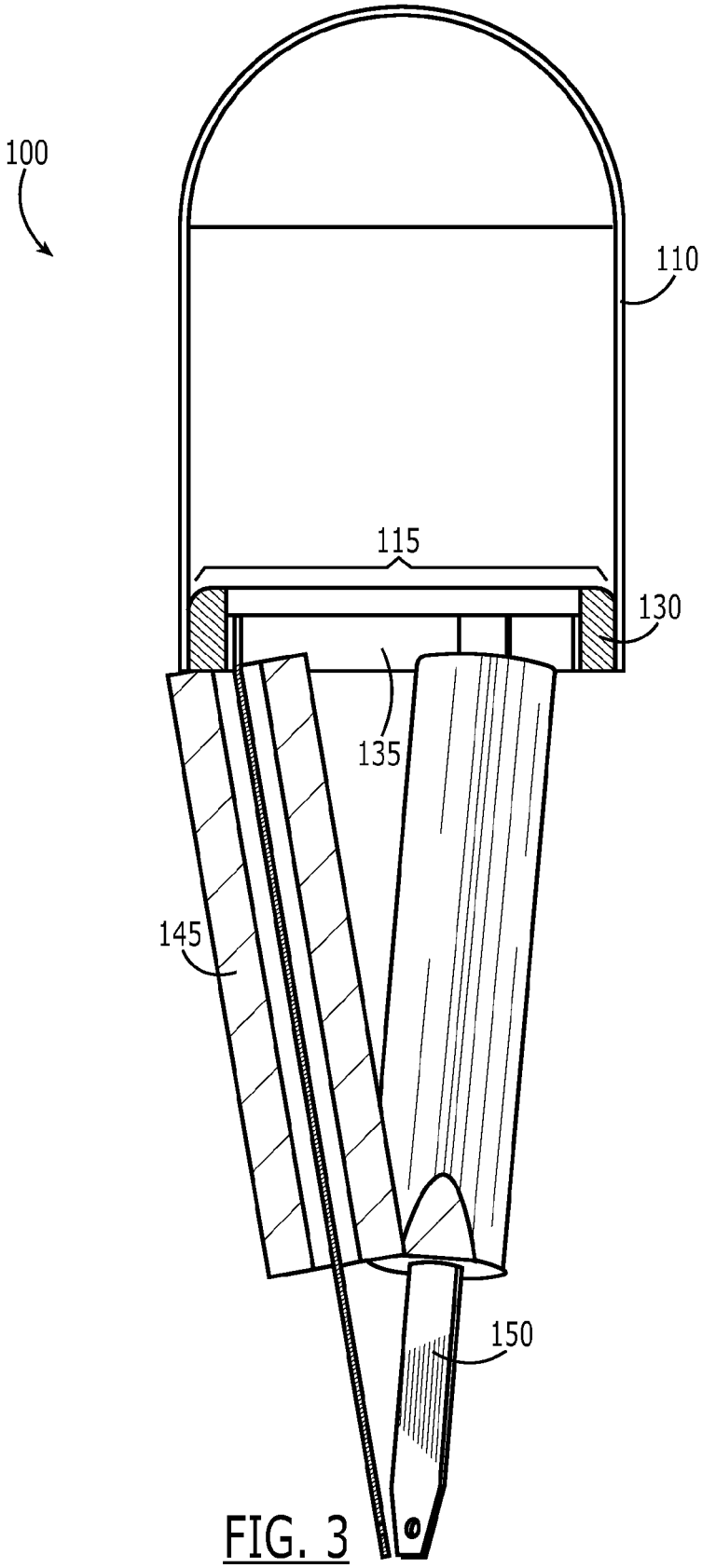
FIG. 3 illustrates a lengthwise cross sectional view of the buoy system illustrated in FIG. 1.
Figure 4:
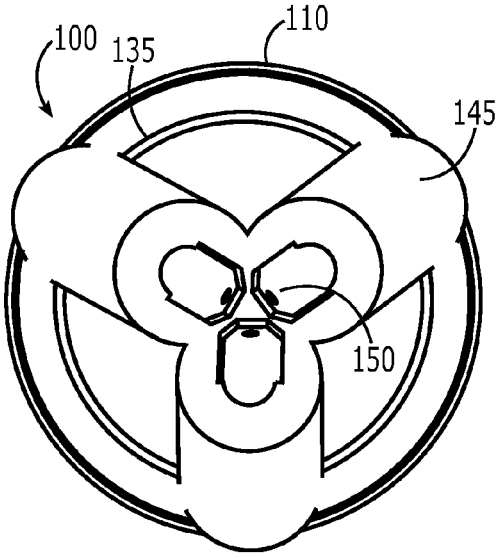
FIG. 4 illustrates a bottom view of the buoy system illustrated in FIG. 1.

The assembled configuration of the buoy system 100 illustrated in FIG. 1 includes a coupling between the designation member 110 and the buoyancy structure 140. The coupling includes a lengthwise alignment of both the designation member 110 and the buoyancy structure 140. A portion of the buoyancy structure 140 may be internally coupled within the opening 115 of the designation member 120 to facilitate the coupling. As discussed above, the length of the exposed buoyancy structure 140 may be longer than the length of the designation member to facilitate/encourage proper orthogonal buoyancy alignment with respect to the water surface. The coupling between the designation member 120 and the buoyancy structure 140 further includes a circular member 130 intercoupled therebetween. The circular member 130 is shaped to substantially correspond to the internal diameter of the opening 115. In addition, the circular member 130 is shaped to receive and releasably couple with the frame 135. The cross section view of FIG. 3 illustrates the intercoupling between the frame 135, circular member 130, and the flexible rubber member 110 via the opening 115. The coupling between the designation member 120 and the buoyancy structure 140 may further include some form of radial coupling such as a rivet or a chemical adhesive. The resulting orientation of the coupled components causes the conically oriented members 150 to conically extend from an open region to a region of substantially distal proximity to the opening 115 of the designation member 120. In addition, the conical shape of the conically orientated members 150 and the buoyancy members 145 is substantially orthogonal to the opening 115 diameter. This orthogonal orientation thereby biases the orientation of the buoy system 100 to be orthogonal to the water surface.

Figure 5:
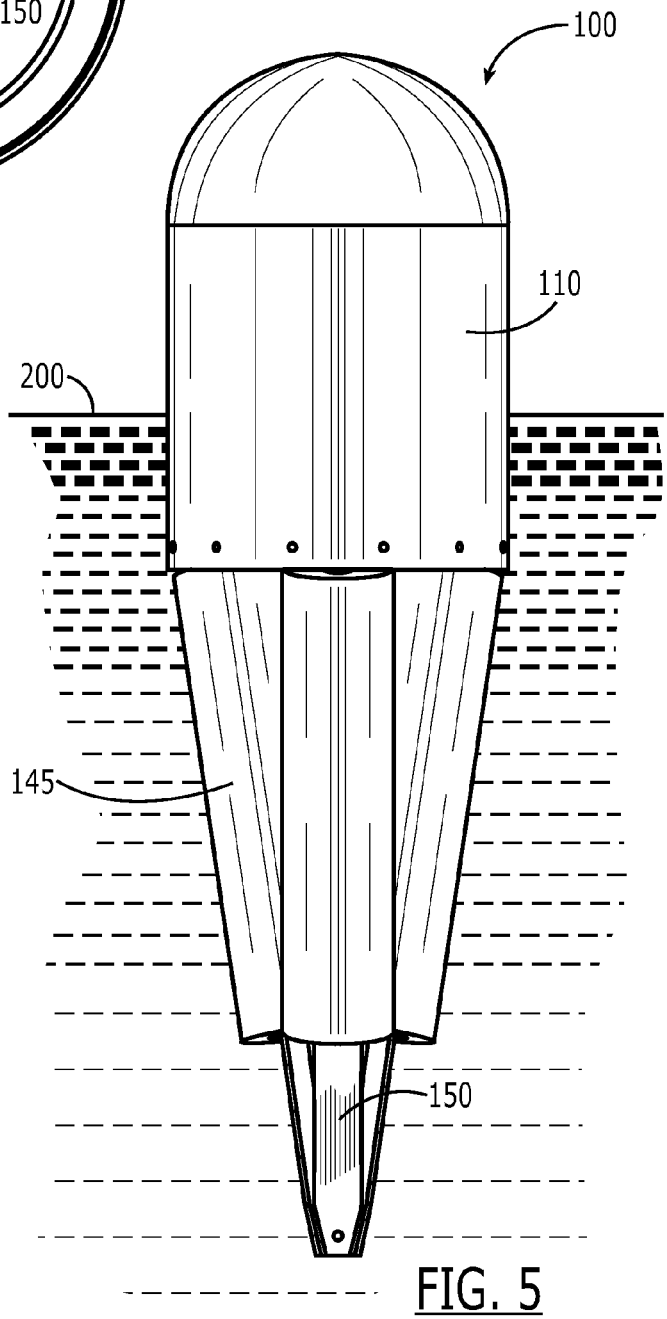
FIG. 5 illustrates a profile operation view of the buoy system illustrated in FIG. 1 with respect to a water surface.

In operation, the assembled buoyancy system 100 may be used to designate a particular location on a water surface. FIG. 5 illustrates an operational profile view of the buoy system 100 with respect to a water surface 200. Upon contact with a water surface 200, the weight, composition, and orientation of the system 100 components causes the buoyancy structure 140 to submerge below the water surface 200 in a substantially orthogonal orientation with respect to the water surface 200. In addition, a portion of the designation member 120 will submerge below the water surface 200. The resulting configuration and submersion further causes the internal region within the flexible rubber member 110 to be enclosed by the water surface 200. The enclosure of the internal region with a water surface 200 causes a non-pressurized or ambient air bubble to form within the internal region of the flexible rubber member 110. The non-pressurized air bubble biases orthogonal alignment and elevational flotation of the exposed portion of the designation member with respect to the water surface 200. In addition, the conical distal orientation of the conically oriented members 150 and the buoyancy members 145 with respect to the opening further biases the orthogonal lengthwise alignment of the system 100 with respect to the water surface 200. If the designation member 120 is impacted by a floating object upon the water surface 200, the enclosed internal region will safely deflate. The deflation of the internal region of the designation member 120 will occur in response to a minimal force mathematically corresponding to the ambient air pressure of the non-pressurized air bubble within the internal region. In addition, deflation of the internal region will not cause a rebound force that substantially affects the impacting flotation object. Therefore, the buoy system 100 overall designates a proper position on a water surface without substantially affecting the trajectory of an impacting object such as a water ski.

A second embodiment of the present invention relates to a method for supporting a buoy on a water surface without compressed air. The method includes providing a designation member with a flexible rubber region and an opening. In addition, the method includes providing a buoyancy structure with a conical lengthwise shape. The buoyancy structure may include a lengthwise orientation longer than the lengthwise orientation of the designation member. The buoyancy structure is lengthwise aligned with the designation member. The lengthwise alignment may include aligning the lengthwise orientation of both the buoyancy structure and the designation member. The buoyancy structure is coupled to the designation member. The coupling may include orienting the tip of the conically shaped buoyancy structure distal to the designation member. The coupling may also include internally coupling the buoyancy structure within the designation member. The buoyancy structure and part of the designation member are submerged below the water surface. The act of submerging of the buoyancy structure and the designation member may include creating an enclosed internal region within the designation member via the water surface. An internal air bubble is formed within the flexible rubber region of the designation member. The forming of the air bubble may also include forming a bubble of air within an internal region between the designation member and the water surface. The forming of the air bubble may further include forming a non-pressurized region of air within the internal region that supports the orthogonal alignment of the buoy with respect to the water surface.

It should be noted that various alternative system designs may be practiced in accordance with the present invention, including one or more portions or concepts of the embodiment illustrated in FIG. 1 or described above. Various other embodiments have been contemplated, including combinations in whole or in part of the embodiments described above.

What is claimed is:

1. A method for supporting a buoy on a water surface without compressed air comprising the acts of:

providing a designation member with a flexible rubber region and an opening;

providing a buoyancy structure with a conical lengthwise shape;

lengthwise aligning the buoyancy structure with the designation member;

coupling the buoyancy structure to the designation member;

submerging the buoyancy structure and part of the designation member below the water surface, wherein the buoyancy structure substantially provides buoyancy for the buoy; and forming an internal air bubble within the flexible rubber region of the designation member.

2. The method of claim 1, wherein the act of lengthwise aligning the buoyancy structure with the designation member includes aligning the lengthwise orientation of both the buoyancy structure and the designation member.

3. The method of claim 1, wherein the act of coupling the buoyancy structure to the designation member includes orienting the tip of the conically shaped buoyancy structure distal of the designation member.

4. The method of claim 1, wherein the act of coupling the buoyancy structure to the designation member includes internally coupling the buoyancy structure within the designation member.

5. The method of claim 1, wherein the act of forming an internal air bubble within the flexible rubber region of the designation member includes forming a bubble of air within an internal region between the designation member and the water surface.

6. The method of claim 5, wherein the act of forming a bubble of air within an internal region between the designation member and the water surface includes forming a non-pressurized region of air within the internal region that supports the orthogonal alignment of the buoy with respect to the water surface.

7. The method of claim 1, wherein the act of submerging the buoyancy structure and part of the designation member below the water surface includes creating an enclosed internal region within the designation member via the water surface.

8. The method of claim 1, wherein the act of providing a buoyancy structure with a conical lengthwise shape includes providing the buoyancy structure with a lengthwise orientation longer than the lengthwise orientation of the designation member.

* * * * *